US009522311B2

(12) United States Patent
Doi et al.

(10) Patent No.: US 9,522,311 B2
(45) Date of Patent: Dec. 20, 2016

(54) IRON GOLF CLUB HEAD AND IRON GOLF CLUB

(71) Applicants: Mizuno Corporation, Osaka (JP); Chuo Industries, Ltd., Hiroshima (JP)

(72) Inventors: Kazuhiro Doi, Osaka (JP); Jun Yoshikawa, Hiroshima (JP)

(73) Assignees: MIZUNO CORPORATION, Osaka (JP); CHUO INDUSTRIES, LTD., Hiroshima (JP)

( * ) Notice: Subject to any disclaimer, the term of this patent is extended or adjusted under 35 U.S.C. 154(b) by 120 days.

(21) Appl. No.: 14/479,698

(22) Filed: Sep. 8, 2014

(65) Prior Publication Data

US 2015/0072804 A1 Mar. 12, 2015

(30) Foreign Application Priority Data

Sep. 11, 2013 (JP) ..... 2013-187852

(51) Int. Cl.

| | |
|---|---|
| ***A63B 53/04*** | (2015.01) |
| ***C21D 8/00*** | (2006.01) |
| ***C22C 38/00*** | (2006.01) |
| ***A63B 53/06*** | (2015.01) |
| ***C21D 9/00*** | (2006.01) |
| ***C21D 1/18*** | (2006.01) |

(52) U.S. Cl.

CPC ..... *A63B 53/047* (2013.01); *A63B 53/06* (2013.01); *C21D 1/18* (2013.01); *C21D 8/00* (2013.01); *C21D 9/0068* (2013.01); *C22C 38/00* (2013.01); *A63B 2053/0408* (2013.01); *A63B 2053/0433* (2013.01)

(58) Field of Classification Search

CPC ..... A63B 53/047; A63B 2053/0416; A63B 53/04; A63B 2209/00

USPC ..... 473/324–350

See application file for complete search history.

(56) References Cited

U.S. PATENT DOCUMENTS

| | | | | |
|---|---|---|---|---|
| 3,904,401 | A * | 9/1975 | Mertz | C22C 38/001 148/327 |
| 5,094,812 | A * | 3/1992 | Dulmaine | C22C 38/001 420/57 |
| 5,378,295 | A | 1/1995 | Yamashita et al. | |
| 5,472,203 | A * | 12/1995 | Schmidt | A63B 53/04 473/350 |

(Continued)

FOREIGN PATENT DOCUMENTS

| | | |
|---|---|---|
| EP | 0496350 A1 | 1/1992 |
| EP | 1240924 A | 9/2002 |

(Continued)

OTHER PUBLICATIONS

Notice of Allowance in related Japanese Patent Application No. JP2014180842, mailed Nov. 26, 2015.

(Continued)

*Primary Examiner* — Nini Legesse

(74) *Attorney, Agent, or Firm* — Troutman Sanders LLP; James E. Schutz; Daniel T. Sharpe

(57) ABSTRACT

In an iron golf club head with a face portion and a neck portion integrally molded by forging, the iron golf club head is made of an iron steel material at least containing 0.30% by weight or less of carbon and 0.0005% by weight to 0.003% by weight of boron. The face portion has been subjected to quenching processing.

6 Claims, 3 Drawing Sheets

(56) References Cited

U.S. PATENT DOCUMENTS

| | | | | |
|---|---|---|---|---|
| 6,346,052 | B1 | 2/2002 | Chappel | |
| 6,520,868 | B2 | 2/2003 | Chen | |
| 2002/0082119 | A1* | 6/2002 | Hamada | A63B 53/04 473/350 |
| 2002/0160852 | A1* | 10/2002 | Chen | C22C 38/44 473/324 |
| 2006/0025237 | A1* | 2/2006 | Aguinaldo | A63B 53/047 473/350 |
| 2009/0111607 | A1* | 4/2009 | Taylor | A63B 53/04 473/350 |

FOREIGN PATENT DOCUMENTS

| | | | |
|---|---|---|---|
| JP | 05253323 | A | 10/1993 |
| JP | 08257182 | A | 10/1996 |
| JP | 2001190720 | A | 7/2001 |
| JP | 2002523154 | A | 7/2002 |
| JP | 2005-007049 | A | 1/2005 |
| JP | 4331635 | B2 | 9/2005 |
| JP | 2006255016 | A | 9/2006 |
| WO | 0010652 | A1 | 3/2000 |
| WO | 0232514 | A1 | 4/2002 |

OTHER PUBLICATIONS

European Search Report dated Feb. 11, 2015 for European patent application No. 14184144.5.

English Translation of the Notice of Grounds of Rejection for counterpart Japanese Application No. 2014-180842 mailed Sep. 3, 2015.

* cited by examiner

IRON GOLF CLUB HEAD AND IRON GOLF CLUB

This nonprovisional application is based on Japanese Patent Application No. 2013-187852 filed on Sep. 11, 2013 with the Japan Patent Office, the entire contents of which are hereby incorporated by reference.

BACKGROUND OF THE INVENTION

Field of the Invention

The present invention relates to an iron golf club head and a golf club.

Description of the Background Art

One of capabilities required of iron golf clubs is high restitution performance. In conventional iron golf clubs, a high strength material, such as chromium molybdenum steel (chromoly steel) or maraging steel, for example, is used to reduce the thickness of a face, thereby achieving high restitution performance.

In the sales market of iron golf clubs, custom fitting for adjusting the lie and/or loft angles in accordance with golfer's swing is widely available. In the custom fitting, a skilled craftsman adjusts the lie and/or loft angles to golfer's desired angles by bending a neck portion of a golf club head.

Here, a high strength material such as chromoly steel is not suited for custom fitting because it is difficult to bend a neck portion made of such a material due to its hardness. Conventionally, a face member and a head body are therefore made of different materials from each other and are welded together to enable angle adjustment of an iron golf club head manufactured through the use of a high strength face material.

Japanese Patent No. 4331635 discloses performing quenching processing only on the face portion after molding chromoly steel by forging to thereby increase hardness of the face portion and to bring the hardness of the neck portion into a level that enables angle adjustment.

In the conventional iron golf club head in which the face portion and the body portion are bonded by welding, however, there is a possibility that a welded portion may become cracked during angle adjustment. Moreover, when the face portion and the body portion are molded by forging separately, the grain flow produced in the forging step is not integral from the body portion including the face to the neck portion. Thus, one cannot feel a good hitting feeling specific to forged iron.

Furthermore, in the iron golf club head described in Japanese Patent No. 4331635, the neck portion has a hardness of HRC 18 to 20 and enables angle adjustment, whereas its workability is actually not necessarily good.

SUMMARY OF THE INVENTION

The present invention was made to solve the above-described problems, and has an object to provide an iron golf club head and an iron golf club exhibiting excellent performance in all of restitution characteristics, angle adjustability and hitting feeling in a balanced manner.

To solve the above-described problems, an iron golf club head according to claim 1 of the present invention is an iron golf club head with a face portion and a neck portion integrally molded by forging. The iron golf club head is made of an iron steel material at least containing 0.30% by weight or less of carbon and 0.0005% by weight to 0.003% by weight of boron. The face portion has been subjected to quenching processing. Accordingly, an iron golf club head exhibiting excellent performance in all of restitution characteristics, angle adjustability and hitting feeling in a balanced manner can be obtained.

The iron golf club head according to claim 2 of the present invention is the iron golf club head according to claim 1 further comprising; a cavity wall which surrounds the circumference of back side of the face portion, and the sole side cavity wall is undercut relative to the face normal direction.

Accordingly, the face portion can be increased in restitution characteristics.

The iron golf club head according to claim 3 of the present invention is the iron golf club head according to claim 1, wherein the iron steel material further contains 0.30% by weight to 1.20% by weight of manganese and 0.01% by weight to 0.05% by weight of titanium. Accordingly, the face portion can be further increased in hardness.

The iron golf club head according to claim 4 of the present invention is the iron golf club head according to claim 1, wherein the hardness of the face portion is HRC 25 or more, and the hardness of the neck portion is HRB 90 or less. Accordingly, improvement in restitution characteristics because of reduced thickness of the face and good angle adjustability of the neck portion can be achieved.

The iron golf club head according to claim 5 of the present invention is the iron golf club head according to claim 1, wherein an undercut extending in a toe-heel direction of the iron golf club head is in the form of a formed pocket or machined slot. Accordingly, the face portion can be improved in restitution characteristics.

The iron golf club head according to claim 6 of the present invention is the iron golf club head according to claim 5, wherein minimum thickness of the sole side undercut area is 1.5 mm to 3.5 mm. Accordingly, the face portion can be deflected more effectively.

The iron golf club head according to claim 7 of the present invention includes the iron golf club head as defined in claim 1.

Accordingly, an iron golf club exhibiting excellent performance in all of restitution characteristics, angle adjustability and hitting feeling in a balanced manner can be obtained.

With the iron golf club according to the present invention, boron-doped carbon steel is used and the head body is molded by forging, and only the face portion is subjected to quenching processing to increase its hardness. Therefore, the neck portion can have hardness equivalent to that of an iron golf club head that enables angle adjustment, while increasing the face portion in hardness. Accordingly, an iron golf club head having a thin face, excellent restitution characteristics and excellent angle adjustability can be easily manufactured as one-piece forged iron.

Moreover, according to the present invention, a continuous grain flow can be formed from the neck portion to the body portion including the face portion. Thus, one can feel a good hitting feeling specific to forged iron.

Furthermore, by providing the undercut for the sole portion, the face can be deflected effectively. Restitution characteristics can thus be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
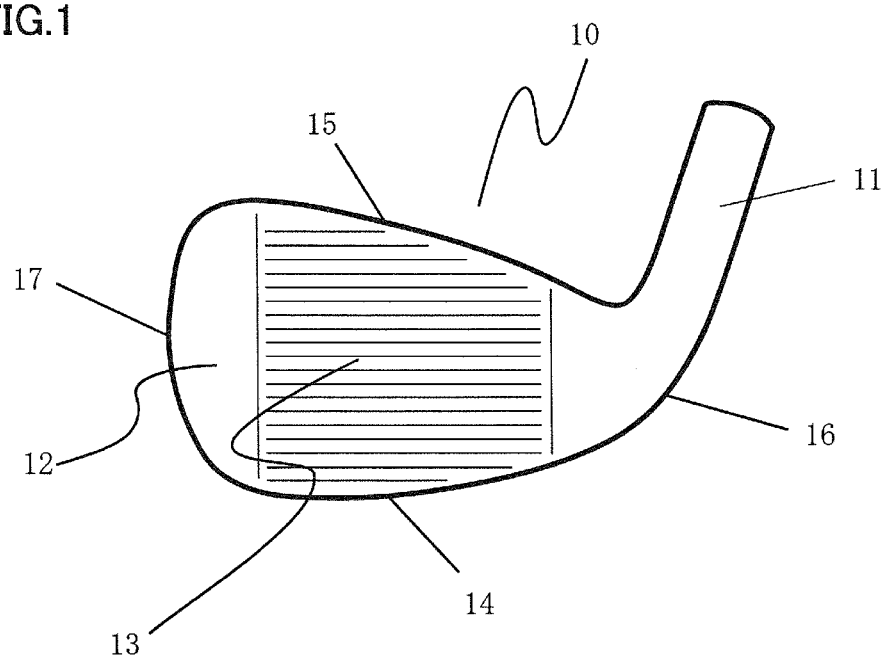
FIG. 1 is a front view of an iron golf club head according to a first embodiment of the present invention.
Figure 2:
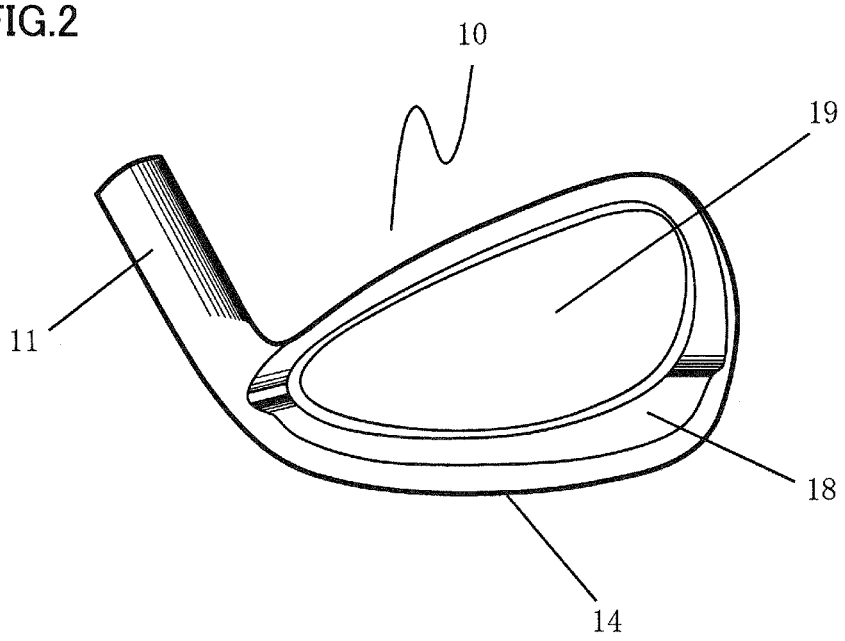
FIG. 2 is a rear view of the iron golf club head according to the first embodiment of the present invention.

FIG. 1 shows a front view of an iron golf club head 10 according to the present first embodiment, and FIG. 2 shows a rear view of iron golf club head 10.

In FIG. 1, iron golf club head 10 (hereinafter referred to as "head 10" appropriately) is composed of a neck portion 11 to which a shaft is connected and a body portion 12 serving as a ball hitting portion. Neck portion 11 includes a region to be bent when adjusting the lie and/or loft angles.

Body portion 12 has a face portion 13 serving as a ball hitting surface, a sole portion 14 constituting the bottom of head 10, a top edge portion 15 constituting the upper end edge portion of head 10, a heel portion 16 connecting the lower end of neck portion 11 and sole portion 14, and a toe portion 17 connecting sole portion 14 and top edge portion 15 at a position opposed to heel portion 16. In head 10 having the above-described structure, neck portion 11 and body portion 12 are formed integrally by forging molding.

On the rear surface side of head 10, a cavity wall portion 18 surrounding the circumference of face portion 13 on the rear surface side is formed as shown in FIG. 2. This cavity wall portion 18 defines a cavity 19.

From the viewpoint of simultaneously achieving good restitution characteristics and durability, face portion 13 preferably has a thickness of approximately 1.5 mm to 3.0 mm, more suitably 2.2 mm to 2.6 mm. In addition, the thickness of face portion 13 is set at approximately ⅙ to ⅕ of the contour of neck portion 11. This is for creating a difference in thermal capacity between face portion 13 and neck portion 11 such that a temperature difference of 100° C. or more occurs between face portion 13 and neck portion 11 after forging. When the face has a constant thickness, the thickness of face portion 13 in the present invention is defined as the thickness at any point on the face, and in such a case where face portion 13 has a gradual thickness distribution, it is defined as the thickness at the face center.

Face portion 13 has a hardness of 25 or more in Rockwell hardness (HRC) at the central portion of the cross section of the face center. By setting the hardness of face portion 13 at HRC 25 or more, a face thickness of 1.5 mm to 3.0 mm can be achieved. On the other hand, neck portion 11 has a hardness of 90 or less in Rockwell hardness (HRB) at the center of a substantially circular cross section of the neck portion. This is because if neck portion 11 has a hardness of more than HRB 90, angle adjustability in custom fitting will be degraded.

There are no limitations on the shape of sole portion 14 and cavity wall portion 18, and they can have any shape depending on the center of gravity position of head 10, design of the value of moment of inertia, and the like.

Next, the material of iron golf club head 10 will be described. In the following description, the added amount of each additive is expressed in a percentage by weight.

As the material of head 10, boron-doped carbon steel in which carbon steel contains boron as an additive component is used. A suitable upper limit of the carbon content is 0.30%. This is to make the hardness of neck portion 11 be on the same level as the neck hardness of forged iron in which carbon steel (S25C) having the carbon content of approximately 0.25% is used. The boron content is approximately 0.0005% to 0.003%. Boron is added for the purpose of improving quenchability in the manufacturing step of head 10. Even if a small amount of boron is added, quenchability can be improved, and its effect can be achieved even by the added amount of approximately 0.0005%. On the other hand, the quenching effect will not be changed even if boron is added in a certain amount or more. Therefore, the upper limit of added amount of boron may be set at approximately 0.003%. A more preferable added amount of boron ranges from 0.002% to 0.003% from the viewpoint of allowing reliable improvement in quenchability and allowing management and adjustment of a very small added amount of boron.

Additive components that may be added in addition to boron are manganese and titanium. Manganese can improve quenchability by the addition thereof, similarly to boron. The added amount of manganese is preferably 0.30% to 1.20%, and more suitably 0.90% to 1.20%. The reason is as follows. That is, in the present invention, since quenchability is improved by the addition of boron, quenchability can be efficiently enhanced with the addition of approximately 0.30% of manganese. When the added amount of manganese is set at approximately 0.90% to 1.20%, quenchability can be enhanced even in the inside of the thick portion of head 10. The hardness in the thick portion can thus be increased.

Titanium is added in order to suppress generation of boron nitride that would be produced by the addition of boron. Boron is likely to be bonded to nitrogen in steel. When boron and nitrogen are bonded to produce boron nitride, the effect of addition of boron will be less likely to be obtained. Therefore, titanium is added to produce titanium nitride, thereby ensuring the effect of addition of boron. The added amount of titanium is preferably 0.01% to 0.05%. This is because if the added amount of titanium is less than 0.01%, the effect of addition of boron will be less likely to be ensured. On the other hand, if the added amount of titanium exceeds 0.05%, large titanium nitride will be likely to be produced, which will degrade toughness.

Additive components that can be contained in addition to boron, manganese and titanium are silicon, phosphorus, sulfur, copper, nickel, and chromium with the rest consisting of iron. The reason for adding these additives and a preferable content thereof will be given below.

(Silicon)

Silicon acts as a deoxidizer. If the silicon content is less than 0.24%, quenchability of head 10 will be degraded. On the other hand, the silicon content exceeds 0.28%, quenching crack resistance of head 10 will be degraded. Therefore, the silicon content is set at 0.24% to 0.28%.

(Phosphorus)

If the phosphorus content is high, toughness will be degraded. Therefore, the phosphorus content is preferably as low as possible, and 0.03% or less is preferable.

(Sulfur)

If the sulfur content is high, toughness will be degraded. Therefore, the sulfur content is preferably as low as possible, and 0.03% or less is preferable.

(Copper)

Copper can improve head 10 in strength by the addition thereof. On the other hand, if the copper content is increased, machinability will be degraded. Therefore, the copper content is set at 0.03%.

(Nickel)

Nickel can improve the base material in strength and toughness by the addition thereof. On the other hand, the nickel content is increased, quenchability will be degraded. Therefore, the nickel content is set at 0.02%.

(Chromium)

Chromium is added to improve head 10 in quenchability, similarly to manganese. The chromium content is preferably 0.20% or less. This is because if the chromium content exceeds 0.20%, head 10 will be degraded in quenching crack resistance.

Iron golf club head 10 having the above-described structure can be manufactured as a so-called one-piece forged iron that is obtained by molding a round bar steel material by forging. A manufacturing method thereof will be described below.

First, a boron-doped carbon steel round bar is subjected to warm forging at approximately 700° C. or more and 900° C. or less to integrally mold a face-neck member including a portion corresponding to face portion 13 (hereinafter referred to as a "face part") and a portion corresponding to neck part 11 (hereinafter referred to as a "neck part"). At this time, molding is carried out such that the face part has a thickness smaller than the outer diameter of the neck part.

Next, the face part of the face-neck member is cooled at a cooling rate higher than that for the neck part with the face-neck member held in a forging mold. Specifically, the face part is cooled at a cooling rate higher than that for the neck part by spraying liquid only to the face part. As the cooling condition, cooling at a cooling rate of 80° C./sec to 100° C./sec is preferable for increasing the hardness of face portion 13. In the case of water spray cooling, by way of example, a good result is obtained by spraying water of 4 cm3/sec to 6 cm3/sec for 1.2 seconds to 2.0 seconds. On the other hand, the neck part is cooled at a cooling rate lower than that for the face part by leaving it to cool or cooling by a fan.

Then, the face-neck member having undergone the cooling step is polished to thereby obtain a finished product of iron golf club head 10. By attaching a shaft to neck portion 11 of iron golf club head 10, the iron golf club according to the present invention is obtained.

As the method of cooling the face part, a method of spraying gas only to the face part or a method of immersing only the face part in liquid, such as water or oil, can be employed rather than the above-described water spray cooling method. In particular, the immersion cooling can provide a higher hardness after quenching, so that further reduction in thickness of face portion 13 can be achieved.

Next, the functions and effects of the present invention will be described.

Iron golf club head 10 according to the present invention is characterized in that a steel material obtained by adding a small amount of boron to carbon steel containing the carbon content of 0.3% or less is used as a material, and this is subjected to forging molding. Immediately thereafter, only face portion 13 is subjected to forced cooling to conduct quenching processing.

Here, since quenchability is improved by adding boron to carbon steel, face portion 13 subjected to forced cooling undergoes quenching processing for high hardness. Accordingly, face portion 13 can have a hardness of S25C or more and less than or equal to the hardness of chromoly steel with a face thickness of 1.5 mm to 3.0 mm. On the other hand, since carbon steel to be the base of head 10 is inferior to chromoly steel in quenchability, neck portion 11 not subjected to forced cooling is not hardly quenched. Therefore, neck portion 11 can have hardness equivalent to S25C and less than or equal to the hardness of chromoly steel.

From the foregoing, according to the iron golf club head of the present invention, an iron golf club head combining a thin face portion that can provide good restitution characteristics and a neck portion providing excellent angle adjustability can be achieved. Moreover, since the iron golf club head according to the present invention can be integrally molded in one piece, a continuous grain flow can be produced from the neck portion to the face portion. A good hitting feeling specific to forged iron can thereby be obtained.

Furthermore, the use of an iron steel material having hardness equivalent to S25C as a base steel material can provide excellent forgeability and enhanced productivity. Still further, by enhancing quenchability by the addition of relatively inexpensive boron in a very small amount with respect to other components, the face can be increased in hardness efficiently and at low cost. In particular, the iron golf club head according to the present invention can be manufactured at lower cost than an iron golf club head manufactured through the use of chromoly steel, and restitution performance on a level close to that of chromoly steel can be obtained. By further adding a suitable amount of manganese, quenchability can be enhanced further.

In the present first embodiment, the iron golf club head according to the present invention is integrally molded in one piece, but may be obtained by molding two pieces by welding. Specifically, the iron golf club head can be manufactured by producing a face-neck member by the manufacturing method of the present first embodiment and bonding the face-neck member and back parts produced separately by welding or the like, and then performing polishing.

Second Embodiment

In the present second embodiment, restitution performance is enhanced in the iron golf club head according to the above-described first embodiment by undercutting the sole portion of the cavity relative to the face normal direction, thereby increasing the area of the face rear surface.

Figure 3:
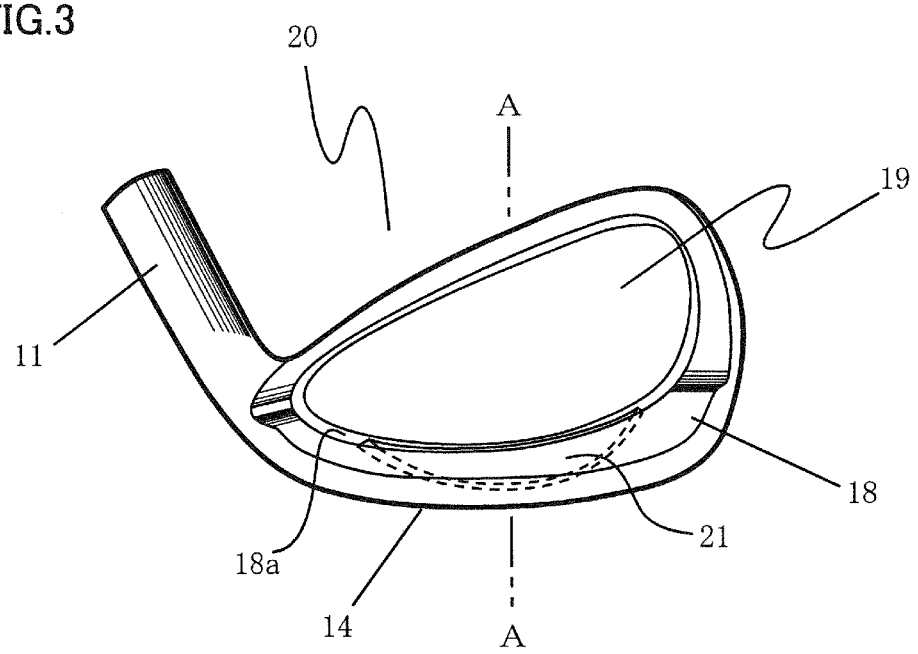
FIG. 3 is a front view of an iron golf club head according to a second embodiment of the present invention.
Figure 4:
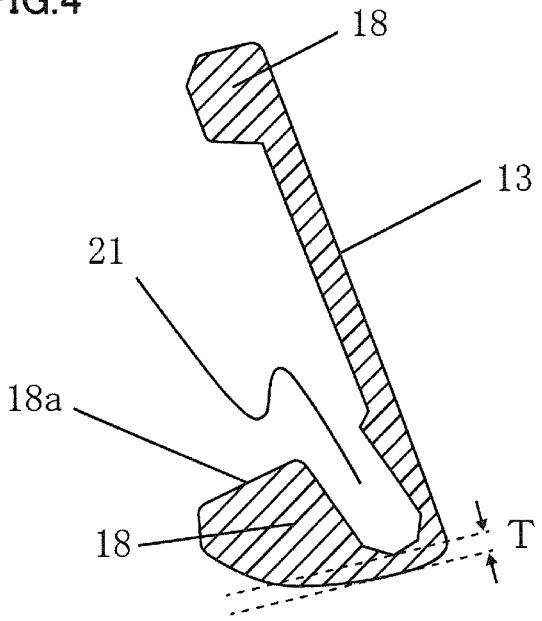
FIG. 4 is a cross-sectional view taken along the line A-A in FIG. 3.

FIG. 3 shows a rear view of an iron golf club head 20 according to the present second embodiment, and FIG. 4 shows a cross-sectional view taken along the line A-A in FIG. 3. In FIGS. 3 and 4, the same components as those in FIGS. 1 and 2 are denoted by the same reference numbers, and description thereof will be omitted.

Iron golf club head 20 has a cavity wall portion 18 on the rear surface side of face portion 13. In cavity wall portion 18, a sole-side wall surface 18*a* that defines the cavity wall surface on the sole side is provided with an undercut 21.

Undercut 21 is a groove formed in the toe-heel direction (TH direction) in sole-side wall surface 18*a*, and is formed in a curved shape with two arbitrary points on the toe and heel sides serving as base points in front view of iron golf club head 20. The length of undercut 21 on a plane in the TH direction, that is, the linear distance between the two points serving as the base points of undercut 21 is approximately 40 mm to 60 mm with which the effective deflection length of face portion 13 may be varied appropriately. The term "effective deflection length" as used herein refers to the length in the vertical direction (the direction from sole portion 14 toward top edge portion 15) of a portion of face portion 13 that is considered to be mainly deformed by deflection when face portion 13 hits a ball, and more specifically refers to the length from the top edge-side end on the bottom surface of cavity 19 (on the rear surface of the face) to the bottom surface of undercut 21. The width of undercut 21 is approximately 1.5 mm to 4.0 mm because of machining constraints.

A thickness T of a thinnest part of sole portion 14, that is, the thickness of sole portion 14 provided with undercut 21 can be made equivalent to or less than the thickness of face portion 13. By way of illustration, the lower limit of thickness T of the thinnest part of sole portion 14 can be set at 2.0 mm when face portion 13 has a thickness of 2.6 mm. The lower limit of thickness T of the thinnest part of sole portion 14 can be set at 1.5 mm when face portion 13 has a thickness of 2.5 mm. The lower limit of thickness T of the thinnest part of sole portion 14 can be set at 1.4 mm when face portion 13 has a thickness of 2.2 mm.

In the vertical cross section where head 10 is placed on a horizontal plane so as to attain set loft and lie angles, thickness T of the thinnest part of sole portion 14 is defined as the length between point a and point b where the distance between arbitrary point a on an inner circumferential surface of undercut 21 and arbitrary point b on the surface of sole portion 14 becomes the shortest. Therefore, the measuring position of thickness T of the thinnest part of sole portion 14 differs in accordance with the bottom surface shape of undercut 21, the shape of sole portion 14, or the cutting angle of undercut 21 which will be described later. The face thickness in the present second embodiment is defined by the thickness at the bottom surface of cavity 19 (on the back side of face portion 13), and the face thickness at undercut 21 portion is not taken into consideration.

Undercut 21 is cut with a T-slot cutter or the like, and is not merely cut in parallel to the rear surface of face 11, but may also be cut in the face surface at an angle of approximately 10 degrees from a position slightly offset toward the back side with respect to the rear surface of face portion 13. The shape of undercut 21 is not limited to the curved shape, but can be a rectangular shape, an inverted trapezoidal shape, or a combination of a plurality of curves when seen in front view, as long as the effective face length can be ensured.

Undercut 21 is obtained not only by cutting cavity wall portion 18, but also by cutting, from the sole portion 14 side, a slit extending through sole portion 14 and cavity wall portion 18 and filling an opening on the sole portion 14 side by welding. Sole portion 14 and cavity wall portion 18 are not limited in shape, and thick heavy portions may be provided for sole portion 14 in the vertical and TH directions, respectively, for example.

Iron golf club head 20 according to the present second embodiment can be obtained by, in the step of manufacturing iron golf club head 10 according to the above-described first embodiment, cutting undercut 21 with a T-slot cutter after performing the quenching processing by water spray cooling, and thereafter performing the polishing step. By attaching the shaft to neck portion 11 of iron golf club head 20, the iron golf club according to the present invention is obtained. Forging conditions, quenching conditions and the like can be made identical to those in the first embodiment.

As described above, according to iron golf club head 20 of the present second embodiment, undercut 21 is provided in sole-side wall surface 18*a* that defines the cavity wall surface on the sole side, in cavity wall portion 18. Thus, the effective deflection length of face portion 13 can be made longer, and restitution performance can thereby be enhanced.

In particular, since face portion 13 of head 20 according to the present second embodiment is increased in hardness by performing the quenching processing on boron-doped carbon steel, the depth of undercut 21 can be made greater than in a conventional iron golf club head manufactured through the use of S25C. Accordingly, the deflection amount of the face on the sole side, which is typically rigid, can be increased, and the balance between the deflection amount on the top edge side and the deflection amount on the sole side can be uniformized. As a result, the face can be deflected uniformly in the vertical direction when hitting a ball, which enables restitution performance of the face to be exhibited sufficiently.

Since the hardness of neck portion 11 can be made equivalent to that of a conventional head manufactured through the use of S25C, angle adjustability applicable to custom fitting can be ensured. Furthermore, a continuous grain flow can be maintained from the neck to the face, so that a good hitting feeling can be obtained.

In iron golf club head 20 according to the present second embodiment, it is also possible to form undercut 21 after forging and thereafter perform the step of quenching face portion 13, as an alternative to the above-described manufacturing step.

That is, a boron-doped carbon steel round bar is subjected to warm forging at approximately 700° C. or more and 900° C. or less to integrally mold the face-neck member. Next, the face-neck member is once cooled by leaving it to cool, for example, and undercut 21 is cut with a T-slot cutter or the like. Thereafter, the face-neck member is raised in temperature to a temperature where quenching is possible, and only the face portion is subjected to water spray cooling similarly to the first embodiment, so that the entire face portion including the region of undercut 21 undergoes quenching. Then, the face-neck member may be fully cooled and then polished to obtain a finished product of iron golf club head 20.

In this manner, by conducting quenching of face portion 13 after the step of cutting undercut 21, face portion 13 can be quenched uniformly in its vertical direction. In particular, in an iron golf club head having a thick mass portion at sole portion 14, the face surface corresponding to the thick portion of sole portion 14 has poor quenchability, which may cause a difference in hardness between the top side and the sole side at the face surface after quenching. In this respect, the entire face including the undercut-formed portion can be quenched uniformly by performing the step of quenching face portion 13 after forming undercut 21. Thus, deviation in deflection of the face surface in the vertical direction resulting from fluctuations in face hardness can be solved, which allows better restitution characteristics to be obtained.

Figure 5:
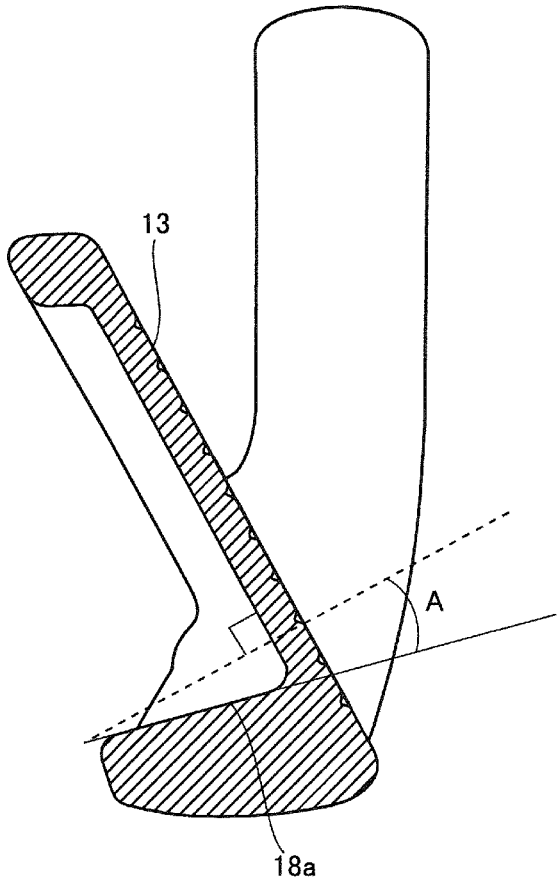
FIG. 5 is a cross-sectional view showing an undercut of the iron golf club head according to the second embodiment of the present invention.

The undercut of the present second embodiment is not limited to the one obtained by slot machining. For example, as shown in FIG. 5, the undercut may be a pocket-like recess formed between sole-side wall surface 18*a* and the rear surface of face portion 13 by inclining sole-side wall surface 18*a* toward the face surface (at an angle A) with respect to the vertical surface of face portion 13.

EXAMPLES

Hereinafter, examples of the present invention and comparative examples will be described.

Table 1 shows the composition of a steel material to be a raw material of each of iron golf club heads of Examples 1 to 5 of the present invention and Comparative Examples 1 to 3. Table 2 shows the structure of each of Examples 1 to 5 and Comparative Examples 1 to 3.

TABLE 1

| | Chemical Composition (wt %) | | | | | | | | | | | |
|---|---|---|---|---|---|---|---|---|---|---|---|---|
| | C | Si | Mn | Ti | P | S | Cu | Ni | Cr | Mo | B | Fe |
| Examples 1, 2, 3, 4 | 0.26 | 0.22 | 0.96 | 0.02 | 0.017 | 0.012 | 0.01 | 0.02 | 0.14 | — | 0.0022 | rest |
| Example 5 | 0.21 | 0.25 | 0.90 | 0.02 | 0.022 | 0.012 | 0.01 | 0.02 | 0.15 | — | 0.0011 | rest |
| Comparative Examples 1, 2 (S25C) | 0.24 | 0.21 | 0.41 | — | 0.006 | 0.006 | 0.01 | 0.07 | 0.12 | — | — | rest |
| Comparative Example 3 (chromoly steel) | 0.36 | 0.24 | 0.77 | — | 0.024 | 0.015 | 0.12 | 0.06 | 0.99 | 0.16 | — | rest |

TABLE 2

| | Specifications | | | | |
|---|---|---|---|---|---|
| | Face Thickness (mm) | Smallest Thickness of Sole Portion (mm) | Undercut | Weight (g) | Hosel Diameter (mm) |
| Example 1 | 2.6 | NA | not provided | 280 | 13.2 |
| Example 2 | 2.2 | NA | not provided | 280 | 13.2 |
| Example 3 | 2.5 | 3.5 | provided | 280 | 13.2 |
| Example 4 | 2.5 | 1.5 | provided | 280 | 13.2 |
| Example 5 | 2.6 | 1.5 | provided | 280 | 13.2 |
| Comparative Example 1 | 2.9 | NA | not provided | 280 | 13.2 |
| Comparative Example 2 | 2.9 | 3.5 | provided | 280 | 13.2 |
| Comparative Example 3 | 2.2 | NA | not provided | 280 | 13.2 |

Examples 1 and 2 correspond to the above-described first embodiment, and Examples 3 to 5 correspond to the above-described second embodiment. Comparative Example 1 is an iron golf club head manufactured by molding S25C by forging, and Comparative Example 2 was the iron golf club head of Comparative Example 1 provided with an undercut. Comparative Example 3 is an iron golf club head manufactured by molding chromoly steel by forging. Each of these Examples 1 to 5 and Comparative Examples 1 to 3 was manufactured as a number 4 iron.

The iron golf clubs according to Examples 1 to 5 were manufactured as follows. First, a boron-doped carbon steel round bar having a diameter of 27 mm was prepared. The round bar was subjected to rough forging at 1000° C. to 1100° C., and further to precision forging at a temperature of 750° C. to 800° C. to produce a face-neck member. Next, water spray cooling was performed by spraying water of an amount of 5 $cm^3$/sec to the face portion for 2.0 seconds. The neck portion was cooled by leaving it to cool.

In each of Examples 1 and 2, polishing processing was carried out after the termination of cooling of the face-neck member to obtain a finished product. In each of Examples 3 to 5, an undercut was cut with a T-slot cutter after the quenching processing of the face portion, and thereafter polishing processing was carried out to obtain a finished product.

Each of the heads of Examples 1 to 5 and Comparative Examples 1 to 3 produced as described above was measured in face portion hardness, neck portion hardness, restitution characteristics, and durability. A shaft was attached to each head to produce a golf club, and each golf club was measured in hitting feeling and angle adjustability. Table 3 shows the measurement result of these measurement items. Each item was measured as follows.

<Face Portion Hardness>

Apparatus used: Microhardness Testing Machine HM-103 available from Mitutoyo Corporation Load: 500 g Measured position: the center of thickness in cross section of face center <Neck Portion Hardness>

Apparatus used: Microhardness Testing Machine HM-103 available from Mitutoyo Corporation Load: 500 g Measured position: the center of substantial circle in cross section at 35 mm below the neck end face <Restitution Coefficient>

A golf ball (mass: m) was collided with the sweet spot of a golf club head (mass: M) at rest to measure an impingement speed of the ball (the speed of the ball before collision with the face surface) V_IN and a rebound speed (the speed of the ball after collision with the face surface) V_OUT to calculate the restitution coefficient in accordance with the following Equation (1):

$$V_OUT/V_IN=(eM-m)/(M+m) \quad (1)$$

Pinnacle Gold LS sold by ACUSHINET COMPANY stored in a room at about 23° C. was used as the golf ball. The collision speed was set at 40.5 m/s. The club head was fixed such that, when the golf ball was going to collide with the face surface, the ball collided in the direction normal to the face surface so as to achieve bounce to the front side. Measurement was repeated seven times, and calculation was made by averaging five measurements excluding upper and lower values.

<Durability>

Simulation was conducted by a finite element method through the use of analysis software "MECHANICA" to calculate VM stress, and durability of each of the Examples and Comparative Examples was obtained.

<Hitting Feeling>

Ten amateur golfers hit the ball and made replies on hitting feeling in seven levels. These replies were averaged to obtain scores of hitting feeling.

<Angle Adjustability>

Two craftsmen each adjusted the lie angle of each iron golf club head within the range of ±4° and made replies on workability in five levels. These replies were then averaged to obtain scores of angle adjustability.

TABLE 3

| | Measurement Result | | | | | |
|---|---|---|---|---|---|---|
| | Face Portion Hardness | Neck Portion Hardness (HRB) | Restitution Coefficient | Durability (Mpa) | Hitting Feeling | Angle Adjustability |
| Example 1 | HRC 28 | 87 | 0.790 | 480 | 4.5 | 4 |
| Example 2 | HRC 30 | 87 | 0.803 | 570 | 4.4 | 4 |
| Example 3 | HRC 29 | 87 | 0.795 | 490 | 4.3 | 4 |
| Example 4 | HRC 29 | 87 | 0.806 | 595 | 4.3 | 4 |
| Example 5 | HRC 27 | 86 | 0.801 | 580 | 4.3 | 4 |
| Comparative Example 1 | HV 170 | 83 | 0.775 | 320 | 5 | 5 |
| Comparative Example 2 | HV 170 | 83 | 0.781 | 385 | 4.7 | 5 |
| Comparative Example 3 | HRC 35 | 98 | 0.810 | 925 | 3.2 | 2 |

As seen from Table 3, while very good results can be obtained in hitting feeling and angle adjustability, Comparative Examples 1 and 2 are both difficult to reduce the face in thickness, and good results cannot be obtained in restitution characteristics and durability. In Comparative Example 3, while good results can be obtained in restitution characteristics and durability, angle adjustability is not highly evaluated, and hitting feeling is very poorly evaluated.

In contrast, it is recognized that with the iron golf clubs (Examples 1 to 5) according to the present invention, well-balanced good evaluations could be obtained in all of restitution characteristics, durability, hitting feeling, and angle adjustability.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An iron golf club head comprising:

a face portion and a neck portion integrally molded from a single material by forging, the single material being an iron steel material containing:

less than or equal to 0.30% carbon by weight, 0.0005 to 0.003% boron by weight, 0.30 to 1.20% manganese by weight, and 0.01% to 0.05% titanium by weight said face portion having been subjected to quenching processing.

2. The iron golf club head according to claim 1, further comprising; a cavity wall which surrounds the circumference of back side of the face portion, and the sole side cavity wall is undercut relative to the face normal direction.

3. The iron golf club head according to claim 1, wherein the hardness of said face portion is HRC 25 or more, and the hardness of said neck portion is HRB 90 or less.

4. The iron golf club head according to claim 1, wherein an undercut extending in a toe-heel direction of the iron golf club head comprises a formed pocket or machined slot.

5. The iron golf club head according to claim 4, wherein minimum thickness of the undercut is 1.5 mm to 3.5 mm.

6. An iron golf club comprising:

a golf club head comprising:

a face portion and a neck portion integrally molded from a single material by forging, the single material being an iron steel material containing:

less than or equal to 0.30% carbon by weight, 0.0005 to 0.003% boron by weight, 0.30 to 1.29% manganese by weight, and 0.01% to 0.05% titanium by weight, said face portion having been subjected to quenching processing.

* * * * *